US007159668B2

(12) United States Patent
Herrera

(10) Patent No.: US 7,159,668 B2
(45) Date of Patent: Jan. 9, 2007

(54) CENTRALIZER

(75) Inventor: Derek Frederick Herrera, Aberdeen (GB)

(73) Assignee: Futuretec Ltd., Aberdeen (GB)

( * ) Notice: Subject to any disclaimer, the term of this patent is extended or adjusted under 35 U.S.C. 154(b) by 0 days.

(21) Appl. No.: 10/312,023

(22) PCT Filed: Jun. 21, 2001

(86) PCT No.: PCT/GB01/02734

§ 371 (c)(1),
(2), (4) Date: Dec. 20, 2002

(87) PCT Pub. No.: WO01/98621

PCT Pub. Date: Dec. 27, 2001

(65) Prior Publication Data

US 2003/0106719 A1 Jun. 12, 2003

(30) Foreign Application Priority Data

Jun. 21, 2000 (GB) ..... 0015206.6
Dec. 13, 2000 (GB) ..... 0030339.6

(51) Int. Cl.
*E21B 17/10* (2006.01)

(52) U.S. Cl. ..... 166/381; 166/241.6

(58) Field of Classification Search ..... 175/57, 175/320, 325.1, 325.5, 325.6, 325.7, 385, 175/391, 406; 166/381, 382, 241.1, 241.2, 166/241.3, 241.6, 241.7, 311, 170, 173, 175, 166/176

See application file for complete search history.

(56) References Cited

U.S. PATENT DOCUMENTS 2,127,796 A * 8/1938 Willis ..... 166/241.3
2,659,439 A * 11/1953 Baker ..... 166/241.6
2,715,552 A 8/1955 Lane ..... 308/4
2,973,996 A * 3/1961 Self ..... 175/325.7
3,052,310 A * 9/1962 Kinzbach ..... 175/406
3,145,785 A 8/1964 Kellner ..... 175/73
3,172,475 A 3/1965 Moore ..... 166/172
3,276,824 A * 10/1966 Carter ..... 175/325.3
3,289,768 A 12/1966 Solum ..... 166/177
3,916,998 A * 11/1975 Bass et al. ..... 166/301
4,088,185 A * 5/1978 Carson ..... 166/176
4,190,124 A * 2/1980 Terry ..... 175/406
4,275,935 A * 6/1981 Thompson et al. ..... 175/325.7
4,549,613 A * 10/1985 Case ..... 175/325.2
4,557,339 A * 12/1985 Falknor et al. ..... 175/325.4

(Continued)

*Primary Examiner*—William Neuder
(74) *Attorney, Agent, or Firm*—Gifford Krass Groh Sprinkle Anderson & Citkowski PC; Richard A. Fagin

(57) ABSTRACT

A centralizer 10 for mounting on a tubular member such as a section of casing, together with one or more stops 42, 48 for retaining the centralizer thereon. The stops 42, 48 are provided with profiles for engaging the centralizer to restrict rotation thereof. The centralizer 10 may be selectively permitted or restricted from rotation by selection of appropriate stops, and by relative movement of the stops and centralizer on the tubular. Certain embodiments of the centralizer 10 may also include blades 14 on the body thereof, the blades being formed such that the velocity and kinetic energy of fluid flow across the blades is altered, so reducing settling of drill cuttings within the bore and on the centralizer.

37 Claims, 13 Drawing Sheets

U.S. PATENT DOCUMENTS 4,630,690 A * 12/1986 Beasley et al. ..... 175/57
4,796,670 A * 1/1989 Russell et al. ..... 138/110
4,877,092 A * 10/1989 Helm et al. ..... 175/74
4,984,633 A * 1/1991 Langer et al. ..... 166/241.1
4,989,679 A 2/1991 Amaudric du Chaffaut . 175/325
5,095,981 A * 3/1992 Mikolajczyk ..... 166/241.6
5,097,905 A 3/1992 Goodwin ..... 166/378
5,180,021 A * 1/1993 Champion et al. ..... 175/76
5,238,062 A * 8/1993 Reinholdt ..... 166/241.7
5,339,896 A * 8/1994 Hart et al. ..... 166/241.1
5,575,333 A * 11/1996 Lirette et al. ..... 166/241.1
5,692,562 A * 12/1997 Squires ..... 166/68.5
5,740,862 A * 4/1998 Sable ..... 166/241.2
5,797,455 A * 8/1998 Barron et al. ..... 166/241.6
5,901,798 A 5/1999 Herrera et al. ..... 175/325.3
5,908,072 A * 6/1999 Hawkins
6,213,229 B1 * 4/2001 Majkovic ..... 175/325.2
6,227,291 B1 * 5/2001 Carmichael et al. ..... 166/170
6,435,275 B1 * 8/2002 Kirk et al. ..... 166/241.1
6,666,267 B1 * 12/2003 Charlton ..... 166/241.6
6,708,785 B1 * 3/2004 Russell et al. ..... 175/321
2002/0023749 A1 * 2/2002 Kirk et al. ..... 166/241.1
2003/0010540 A1 * 1/2003 Kirk et al. ..... 175/325.5
2003/0150611 A1 * 8/2003 Buytaert ..... 166/241.6

* cited by examiner

CENTRALIZER

FIELD OF THE INVENTION

This invention relates to a centraliser for use when running tubulars into a drilled bore, and to other items that may be utilised in conjunction with centralisers.

BACKGROUND OF THE INVENTION

In the oil and gas exploration and production industry, subsurface hydrocarbon-bearing rock formations are accessed by bores drilled from surface. The drilled bores are lined with tubular members, conventionally metal tubing known as casing or liner; for brevity, reference will be made primarily herein to casing. The casing is typically cemented in the bore by passing a cement slurry up between the annulus between the casing and the bore wall.

Any drilled bore will typically extend through a variety of formation types having different properties, for example formations which may swell after drilling to restrict the bore diameter, due to the chemical interaction with the drilling fluid. Also, when drilling between formations of different hardness, it is common for a ledge to be created at the transition between the formations. Further, in deviated or horizontal bores, drill cuttings can fall out of mud suspension and will often collect on the low side of the bore, to form cuttings beds. If the cuttings are not cleaned from the bore, the presence of the cuttings makes successful running in and cementing of casing more difficult and in some cases impossible. In an effort to overcome these difficulties, a length of casing may be provided with a shoe at its leading end, which shoe may include numerous features, including cutting blades, an eccentric or offset nose, jetting ports and like, all intended to facilitate progress of the casing past obstructions in the bore. To minimise the drag between the casing and the bore wall as the casing is run into the bore, and also to facilitate rotation of the casings as it is run in and during cementing, casing strings are often provided with centralisers at various points along the length of the string. Centralisers are conventionally annular, to permit mounting on the casing, and feature upstanding spaced apart blades which allow fluid and cement passage.

It is among the objectives of the various aspects of the present invention to provide centralisers and other apparatus to facilitate the running in and cementing of casing and other tubulars.

SUMMARY OF THE INVENTION

According to a first aspect of the present invention there is provided a centraliser comprising a body adapted for mounting on a tubular member and defining a plurality of blades, the body being selectively both rotatable and non-rotatable about the member.

This aspect of the invention permits the centraliser to rotate about the tubular member, which may be casing, in situations where this facilitates movement of the casing in a bore. However, if required, the centraliser may be configured to rotate with the casing, which may be useful if the casing is being moved through a bore restriction, and the blades of the centraliser may be utilised to ream or dislodge the restriction.

The invention also relates to a method of running a tubular member into a bore, the method comprising providing a bladed centraliser on the member, and selectively coupling the centraliser to the member and rotating the centraliser with the member.

In certain embodiments of the invention, the centraliser is adapted for mounting towards the lower end of a string of tubular members. Other embodiments may not be so adapted, depending on the operation for which the invention is to be used, and whether the invention is used with casing or liner.

The centraliser may be provided in combination with a stop or other engagement member for mounting on the tubular member, where the stop is adapted to cooperate with the centraliser to permit or restrict relative rotation between the centraliser and the tubular member. Conveniently, the stop is adapted to be fixed relative to the tubular member and the centraliser is adapted to be normally rotatable relative to the member. Preferably, the stop and centraliser define cooperating formations which may selectively engage to restrict rotation therebetween. Most preferably, the centraliser is adapted to be axially movable, at least to a limited extent, relative to the tubular member, and is axially movable into and out of engagement with the stop. The stop and centraliser may be adapted and located such that axial movement of the tubular member through a bore in one direction will tend to separate the stop and centraliser, permitting rotation of the centraliser relative to the member, while movement of the member in the opposite direction will tend to bring the stop and centraliser together, such that the centraliser may be rotated with the member. Thus, the centraliser may be rotatable on the member as the member is run into a bore, to minimise torque and drag on the advancing and possibly rotating member, but may be rotatable with the member as the member is pulled and rotated from the bore (a process known as 'back reaming'). Such rotation of the centraliser may assist in dislodging drill cuttings and obstructions, to facilitate fluid circulation and tubular member movement once running in is recommenced. Thus, if there are difficulties encountered in fluid circulation while running the member in, the member may be pulled back a sufficient distance to engage the centraliser and stop, and the member and centraliser then rotated to clear the obstruction to circulation. Alternatively, the centraliser and stop may be arranged such that the centraliser is rotatable with the member as the member is run into a bore, but is rotatable on the member as the member is pulled or retrieved from the bore. Further, the centraliser may be provided in combination with two stops, the centraliser being provided on the member between the stops and being configured such that the centraliser is selectively rotatable with the member while the member is being run into the bore and also while being retrieved or pulled from the bore.

Either or both of the stops may be reversibly mounted on the member, with a first end of the stop carrying a means for selectively engaging the centraliser such that the centraliser is rotated with the member while a second end does not. This allows the stop to be fitted in either orientation, depending on whether it will be desired during a downhole operation to engage and rotate the centraliser, or whether it will be desired to prevent such engagement and rotation occurring.

The centraliser may be adapted to be non-rotatable relative to the member on experiencing an axial force in excess of a predetermined level, for example on the centraliser encountering an obstruction or restriction which is not initially dislodged or negotiated by axial movement of the centraliser, the centraliser may be pushed into engagement with a cooperating profile or formation on the member, most preferably provided by a stop, which causes the centraliser to rotate with the member and assists in dislodging or otherwise removing or negotiating the obstruction or restriction.

The centraliser which is non-rotatable relative to the member may be adapted to be rotatable relative to the member on experiencing a torque, load, or force above a predetermined level. Thus, if the centraliser encounters a restriction or obstruction which is not overcome or removed by the rotating centraliser, the centraliser may rotate to avoid the tubular member experiencing excessive and potentially damaging forces. This may be achieved by providing a cooperating profile or formation on the member, most preferably provided by a stop, which will disengage on experiencing a predetermined torque. This may be achieved by providing cooperating teeth or the like adapted to ride over one another, a sprung retainer, or a "one-off" release, such as a shear retainer between the stop and the member, or forming a profile from deformable material.

The centraliser blades may take any appropriate configuration to provide a stand-off between the tubular member and the bore wall and permit fluid circulation past the centraliser. The blades may be helical or extend substantially axially or circumferentially, or may be in the form of discrete protrusions or studs. The blades may be continuous or discontinuous, the latter arrangement being preferred to facilitate fluid and cement flow. The blades may be of similar configuration over the length of the centraliser or may vary, and the centraliser may be symmetrical or non-symmetrical. The height of the blades may vary, and the variation may be between circumferentially spaced blades or between axially spaced blades. The height of each individual blade may vary, either continuously or in a stepwise manner. The blades may be provided with cutting edges. In order to promote hole cleaning, the centraliser may be configured such that the centraliser has substantially complete circumferential blade coverage about its horizontal axis.

The blades are preferably separated by flutes, where the flutes may be of substantially constant cross section or which may define a varying cross section, for example the flutes may define a venturi form, to accelerate fluid flow therethrough and facilitate cuttings entrainment, or may be of substantially constant area but vary in form, for example changing from a relatively narrow and deep form to a relatively shallow and wide form to direct a greater proportion of the flow along the bore wall.

Preferably at least one of the blades and flutes are configured to cause a change in fluid velocity, pressure, or flow direction as fluid passes over or through the centraliser. Preferably the blades and flutes are configured to cause fluid velocity or speed to increase as fluid flows between the blades, and to cause fluid velocity or speed to drop as fluid flows beyond the blades. This change in speed or velocity causes the fluid flow to be turbulent, which in turn reduces the build up of particulates and the like around the centraliser and in the bore.

Preferably, the blades and/or flutes are configured to provide a rotational force to the centraliser as fluid passes between the blades. This causes the centraliser to rotate, in the absence of any countervailing force, which serves to entrain cuttings and particulates in the fluid flow, and to prevent settling of cuttings, so reducing the build up of particulates and the like around the centraliser and the bore.

Preferably, the centraliser comprises a body on which the blades are mounted or formed. The body may be in one or more parts and may be of any appropriate material. A bearing may be provided for engaging the tubular element, preferably the bearing being formed to encourage thin film lubrication or formation of a hydrodynamic bearing, and preferably to provide sacrificial self-lubrication in the event that thin film lubrication or hydrodynamic bearing should break down. The bearing may be of the same or different material from the remainder of the body, and may be integral with the remainder of the body or may be provided as a separate part. The bearing may be a sleeve or the like or may provide a discontinuous contact with the tubular member, for example the body may define a number of apertures in which plastics bearing inserts are provided. The blades may also be of the same or different material as the body. In one embodiment the blades are formed of a sacrificial self-lubricating material, such as a high performance plastic, to minimise friction between the centraliser and the bore wall. The body may be formed of a more rigid material, such as a metal, adapted to receive the blades. The blades may be moulded into or otherwise fixed to the body, for example the body may define slots or channels for receiving the blades, which may be fixed to the body by means of a force fit, by adhesive, or by fixings such as screws, bolts or dowels. The body or bearing may be of plastics or metal, including aluminium, aluminium alloy, aluminium bronze, phosphor bronze, cupro-nickel, zinc alloy, brass, copper alloys including gun metal, steel, iron, iron alloy, austempered ductile iron, AB2, phenolic resin, thermoplastics, PPP6, PPP12, PEEK, Nylon® 6.6 polymer Nylon® PA12G polymer, or "V" grade plastic manufactured by Devol Engineering Ltd.

Alternatively, the body or bearing may be formed of one of these materials or from carbon reinforced polyetheretherketone, polytetrafluoroethylene, polyphthalamide, or polyvinylidene fluoride compounds.

Where formed of metal, the body or bearing may be coated with polytetrafluoroethylene (PTFE), electroless nickel, zinc, paints and plastics including: carbon reinforced polyetheretherketone; polyphthalamide; polyvinylidene fluoride compounds; phenolic resins or compounds; thermosetting plastics; thermoplastic elastomers; thermoplastic compounds; thermoplastics including polyetheretherketone, polyphenylenesulfide, polyphthalamide, polyetherimide, polysulphone, polyethersulphone, all polyimides, all polyamides (including nylon compounds), polybutyleneterephthalate, polyetherketoneketone.

Where appropriate the body or bearing material may contain an appropriate filler, such as glass, carbon, PTFE, silicon, molybdenum disulphide, graphite, oil and wax.

Where appropriate the body may be in the form of a frame or cage of harder material (such as metal) on or around which is provided a portion or portions of softer material (such as plastics). This provides some reinforcement to the body to resists stresses. The frame may be in the form of a solid cylinder, or be provided with holes or cutouts, or be in the form of a mesh or network.

The body may be of unitary construction, or may be formed of two or more parts to allow the body to be fitted around a tubular. The ports may be joined by any convenient means, for example a hinge and pin, the ports may snap-fit together, or the ports may be profiled so that they may be slid together.

The centraliser may be provided in combination with one or more stops for mounting on the tubular member, the stops at least limiting axial movement of the centraliser relative to the member. The stops may be mounted on the tubular member in any appropriate manner, however it is preferred that the stop comprises at least two parts, and that when the parts are coupled together a portion of at least one part is urged into engagement with the tubular member. Most preferably, one part defines a male part and the other part defines a female part, the male part being deformable so that it may be urged to assume a smaller diameter on being coupled with the female part. The male part may be slotted or otherwise formed to facilitate deformation.

In another embodiment the stop comprises a body and a radially movable gripping part for selectively engaging the tubular member, and means for urging the gripping part into engagement with the tubular member. The gripping part is preferably in the form of a split ring, and the urging means is in the form of one or more screws or bolts mounted in the body. The gripping part may comprise a high-friction surface, such as aggregate or serrated grooves, to increase the effectiveness of the gripping.

The stop preferably has a tapering leading face, to facilitate movement over ledges and the like and to prevent the build up of cuttings and other debris in front of the stop.

In one embodiment of an aspect of the invention, a centraliser comprises a similar arrangement for securing the centraliser to a tubular member. Conveniently, screws or bolts provided to urge the gripping part into engagement with the tubular member are accommodated in raised or upset portions of the centraliser forming blades or pads of the centraliser.

According to a further aspect of the present invention, there is provided a guide shoe for mounting on the end of a tubular member, the shoe comprising a body having a bore formed therethrough leading to an opening, the opening being in the form of a slot.

A shoe of the present invention may be mounted to the end of a casing string, where the bore and slot allow fluid to be passed through and then exit the shoe to dislodge and entrain cutting waste and the like. The slot formation of the opening causes the fluid flow to extend over a greater length than conventional jetting ports; if a section of the slot should become blocked by for example cuttings, fluid may stilt flow through the remainder of the slot and act upon the blockage to clear it. Thus, the present invention reduces the likelihood of the opening becoming clogged.

Preferably the shoe further comprises cutting structures mounted thereon. These may be, for example, blades or the like, or sections of hard facing material incorporated into the structure of the shoe.

The opening may also comprise portions of hard facing material incorporated therein, to allow the opening to ream or cut sections of the bore or cuttings where necessary.

Preferably the opening further comprises a pin, bolt, or the like mounted therein, extending substantially perpendicular to the direction of the slot. This serves to hold the edges of the slot together, and prevent possible 'flaring' of the edges of the slot should the shoe encounter adverse conditions.

According to an aspect of the present invention there is provided a centraliser for mounting on a tubular member for location in a bore, the centraliser comprising an annular body and a bearing for location between the body and the tubular member.

Preferably, the bearing is formed to encourage thin film lubrication or formation of a hydrodynamic bearing and sacrificial self-lubrication in the event that thin film lubrication or hydrodynamic bearing should break down.

According to a further aspect of the present invention there is provided a body for mounting on a string of tubular members coupled together by connectors defining upsets in the string and for location in a bore, the body having a tapering profile and being adapted for location on an end of a tubular member adjacent a connector, the taper leading from adjacent the surface of the tubular member.

The provision of the tapered body assists in preventing the build up of cuttings and other debris that often occurs at the connectors when a string of tubular members, such as a casing string, is run into a deviated or horizontal bore.

The body may have a maximum outer diameter corresponding to that of the connector, or may define a larger outer diameter than the connector, to provide a stand-off for the connector.

The body may define flutes, blades or pads, to facilitate bore cleaning or fluid flow past the body.

BRIEF DESCRIPTION OF THE DRAWING

These and other aspects of the present invention will now be described, by way of example only, and with reference to the accompanying drawings, in which.

DETAILED DESCRIPTION OF THE PREFERRED EMBODIMENTS

Figure 1:
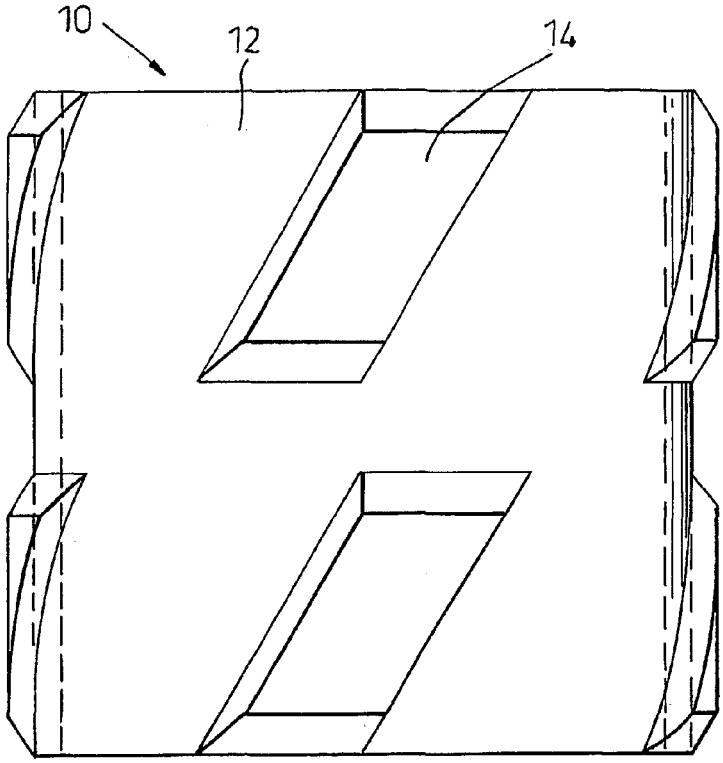
FIG. 1 shows a centraliser in accordance with one embodiment of the invention.

Referring first of all to FIG. 1, this shows a centraliser for mounting on a tubular, particularly casing, in accordance with an embodiment of the invention. The centraliser 10 comprises a cylindrical body 12, on which are mounted a plurality of blades 14. The body 12 in this example is made of steel, while the blades 14 are formed of a plastics material, such as Nylon 6.6. Alternatively, the blades may be formed homogeneously with the body, while the blades and/or the body may incorporate plastic or other low friction inserts or coating on or about the blades or body. Each blade is generally parallelogram-shaped, and stands proud of the surface of the body. The spaces between the blades 14 define an unbroken axial and circumferential flow path for flow of mud, cement, and other flowable preparations past the centraliser.

The centraliser 10 is provided in two sections which fit around a length of casing or drill pipe to enable the centraliser to be fitted and removed without the need to be lifted over the end of the casing. The sections may be provided with interlocking male and female members, or a retaining pin, in order to secure the centraliser on the casing or drill pipe.

Figure 2:
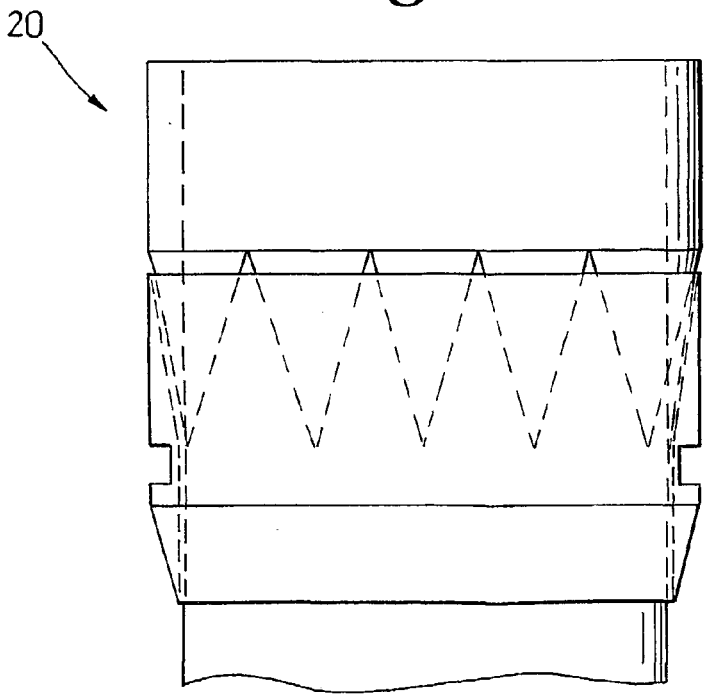
FIG. 2 shows a stop collar as may be used with the centraliser of FIG. 1.
Figure 3:
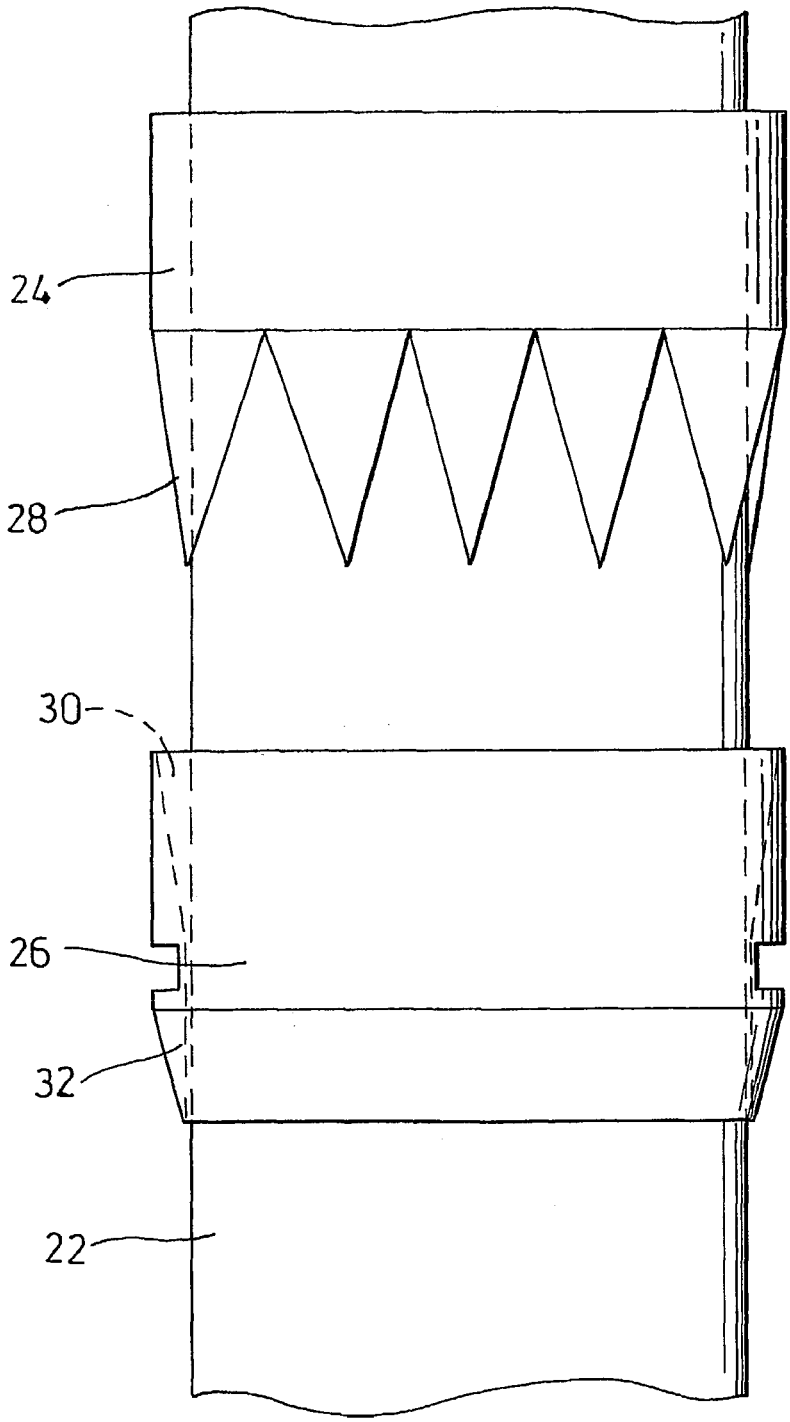
FIG. 3 shows a view of the stop collar of FIG. 2, with the parts of the stop separated.

The centraliser 10 is provided in combination with two stop collars, one of which is illustrated in FIGS. 2 and 3. The stop collar 20 is mounted on a section of casing 22, and is comprised of two sections 24, 26. The upper section 24 is provided with a series of deformable teeth 28 which may fit inside a tapered space 30 provided between the lip of the lower collar section 26 and the casing 22. Co-operating male and female threads, serrations or profiles are provided on the outer surfaces of the teeth 28 and the inner surface of the lower collar section 26. On fitting the collar 20 to a casing section or drill pipe, the two sections 24,26 are relatively rotated, pushed, or compressed to engage the male and female threaded connections. As the sections are rotated, pushed, or compressed further, the tapered space 30 of the lower section 26 forces the teeth 28 radially inwards to engage both the lower section 26 and the surface of the casing 22. With sufficient tightening of the threads, the stop collar 20 will be fixed with respect to the casing 22.

The centraliser 10 may be rotatably mounted on the casing above the stop collar 20; a further stop collar may be located above the centraliser, in the opposite orientation to the collar illustrated in FIG. 3.

The lower edge 32 of the lower portion 26 of the collar 20 is tapered, as is the corresponding portion of the second collar; this eases the flow of fluid over and past the centraliser\collar arrangement, and facilitates passage of the arrangement past ledges and other obstructions.

Figure 4:
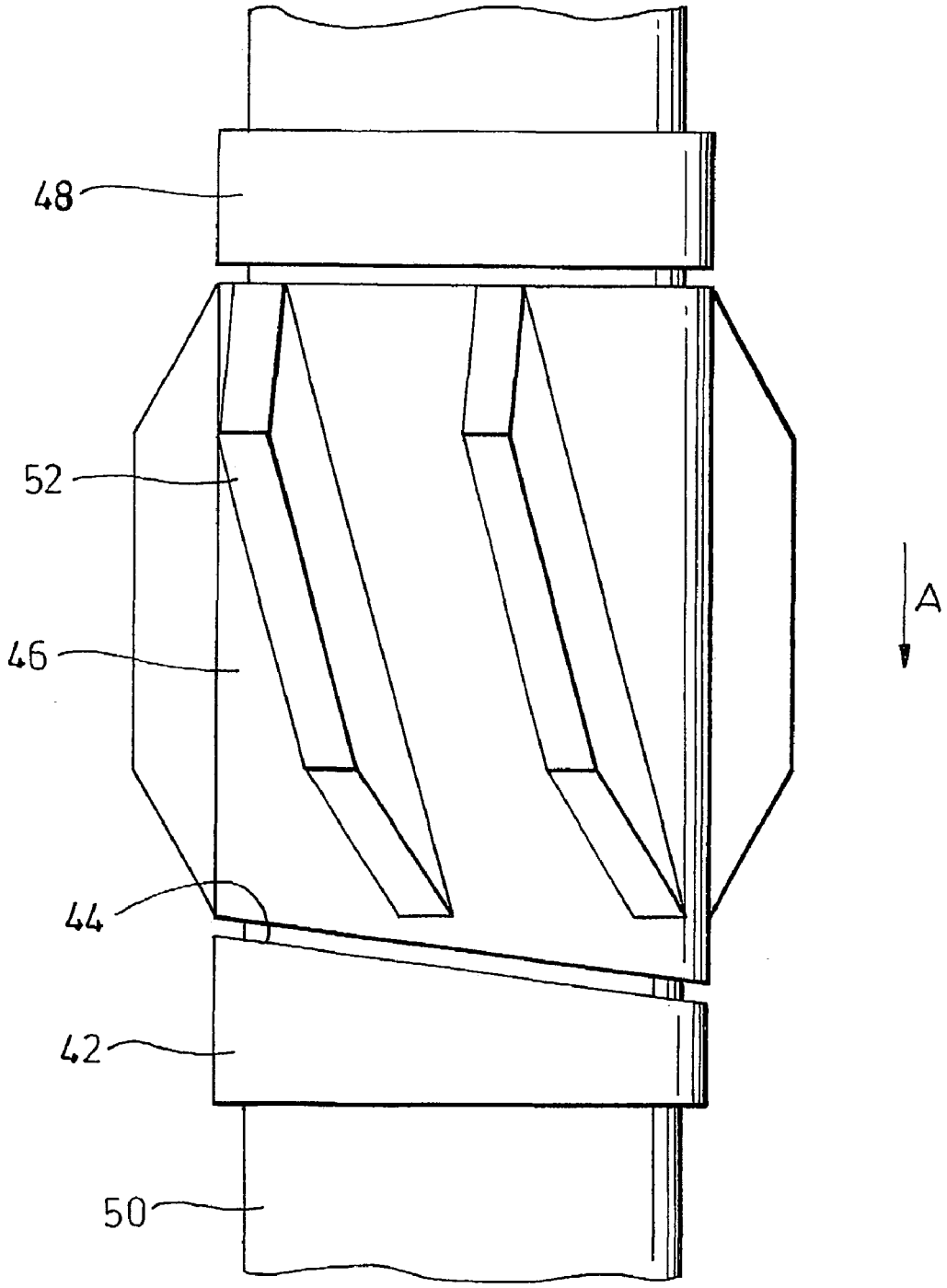
FIG. 4 shows an alternative centraliser in combination with alternative stop collars.

An assembly of centraliser and collars is shown in FIG. 4. In this illustration, the lower collar 42 is provided with an eccentrically-angled upper edge 44; the lower edge of the centraliser 46 is correspondingly shaped. However, the upper collar 48 and the upper edge of the centraliser 46, are provided with co-operating edges, both perpendicular to the casing axis. The collars may be fixed to the casing by means of set screws, bolts, dowels or the like; or by any other suitable means.

As mentioned above, the collars 42, 48 are non-rotatable with respect to the casing 50, while the centraliser 46 is normally rotatable. The centraliser 46 is also free to move axially with respect to the casing 50, within the limits of the stops 42, 48.

As the casing or drill pipe is being lowered into the hole (that is, moving in the direction of arrow A), the centraliser 46 will move upwards until it abuts the upper collar 48. Since the abutting edges are both horizontal (assuming a vertical orientation of the casing), the centraliser 46 will still be free to rotate relative to the casing 50 and collar 48; the centraliser 46 will therefore remain stationary relative to the borehole walls if the casing is rotated, and will act to distance the casing 50 from the bore walls. Also, the abutting surfaces of the centraliser 46 and collar 48 are formed to facilitate relative rotation, the collar 48 defining a plane surface and the centraliser a semi-circular surface. If the casing encounters an obstacle while being run in to a bore, for example, a cuttings bed which restricts fluid circulation and progress of the casing, the casing 50 may be raised slightly in the opposite direction to arrow A. The centraliser 46 will then move downward until it abuts the lower collar 42. The co-operating edges of the collar 42 and centraliser 46 will interlock allowing the centraliser 46 to be rotated with the casing 50. Thus, the blades 52 of the centraliser 46 will be rotating and scraping the bore wall, and thereby assist in dislodging the cuttings. It will be noted that the blades 52 are of slightly different configuration than those shown in FIG. 1.

Once the obstacle has been removed from the bore, the casing 50 may be advanced into the bore once more, and the centraliser 46 will be free to rotate relative to the casing 50.

In alternative arrangements, the relative positions of the stop collars may be reversed, so that the rotating and non-rotating directions of drilling are reversed also.

Although the collars 42, 48 are described as being non-rotating, they may be arranged to rotate when subjected to torque, load, or force above a certain level. For example, the teeth of the collar may be arranged to slip, shear or deform at certain torques, loads, or forces, so allowing rotation of the collar and centraliser preventing damage to the casing.

Collars 42, 48 may further be arranged to disengage into two or more parts, with one part remaining fixed to the casing and the other being a loose bearing which is free to rotate, when subjected to torque, load, or force above a certain level and so allowing rotation of the centraliser but preventing damage to the casing when overloaded. The collar may be formed by two parts held together by any suitable means, such as shear pins, glue, or the like, to slip, shear, or deform at certain torques, loads, or forces, or may be one homogeneous part with a shear groove or notch machined which separates the stop screws and the centraliser engaging means. Alternatively or in combination thereof the collar may be formed in a material which is softer than the centraliser, and so will fail before the centraliser.

The collar/centraliser engagement may be configured in a variety of ways as to restrict relative rotation. This can be absolute, by way of square type/stepped/teeth arrangement, or relative, through an eccentric/sine wave/slip clutch type arrangement. Generally the centraliser will be configured to be able to engage and disengage from the collar. However in some instances it may be preferable that the engagement is designed to be final, such that contact with overriding force will result in the centraliser and stop collar becoming pressure fitted and rigidly and firmly affixed to one another.

Figure 5:
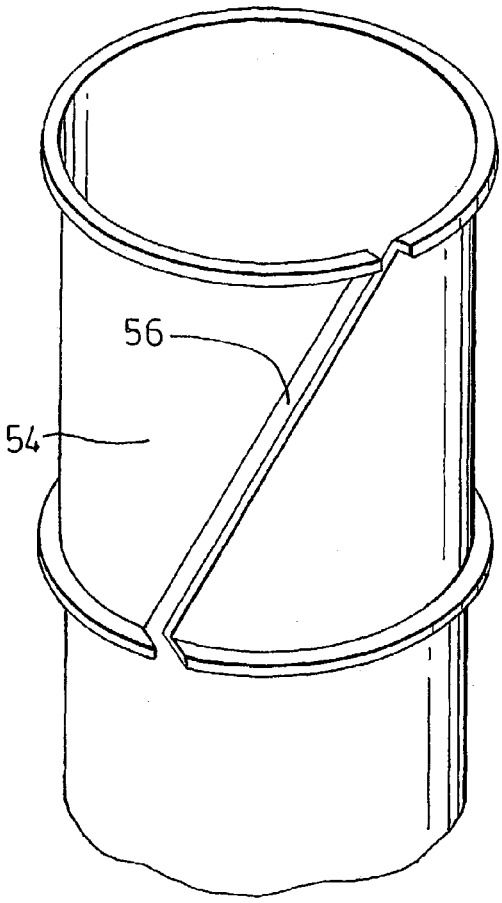
FIG. 5 shows a bearing sleeve as may be used with centralisers in accordance with embodiments of the present invention.

Although the centraliser may be mounted directly on the casing, relative rotation may abrade both the centraliser and the casing. For this reason, a bearing sleeve 54 as illustrated in FIG. 5 may be mounted between the centraliser and casing. The sleeve 54 is a cylinder of plastic or nylon which may be provided with a slit 56 to facilitate mounting over the casing. The bearing sleeve 54 provides sacrificial lubrication to the centraliser. Alternative bearing means may also or instead be provided, for example, ball bearings, fluid film, and the like.

Figure 6:
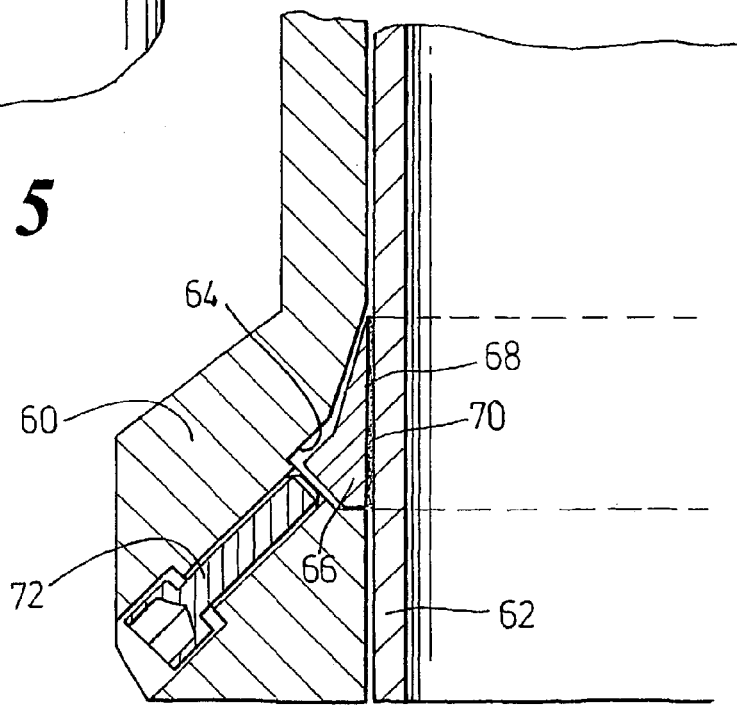
FIG. 6 shows a section of a portion of a centraliser in accordance with an embodiment of the present invention.

An alternative method of securing a centraliser to the casing is illustrated in FIG. 6, which shows an enlarged sectional view of a portion of a centraliser. The centraliser 60 is mounted on a casing 62, and includes an annular recess 64 adjacent the casing 62, which accommodates a deformable annular member 66, the inner face 68 of which is coated with a high friction material 70 (for example, an aggregate). The centraliser 60 is further provided with a number of Allen screws 72 (only one shown) mounted in threaded bores, such that the tip of each screw 72 is in contact with the annular member, while the head of each screw 72 is recessed but accessible from the outside of the centraliser 60. Set screws or the like may instead be used. The screws 72 are accommodated by the thicker material present at the centraliser blades. Tightening of the screws 72 urges the annular member 66 against the casing 62, so fixing the centraliser 60 to the casing.

Figure 7:
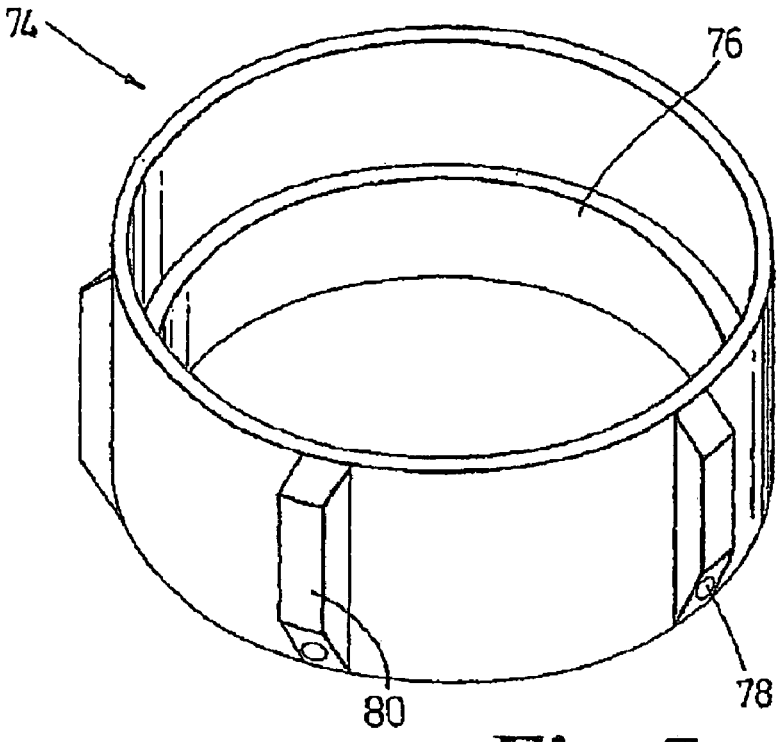
FIG. 7 shows a stop collar as may be used with centralisers in accordance with embodiments of the present invention.
Figure 8:
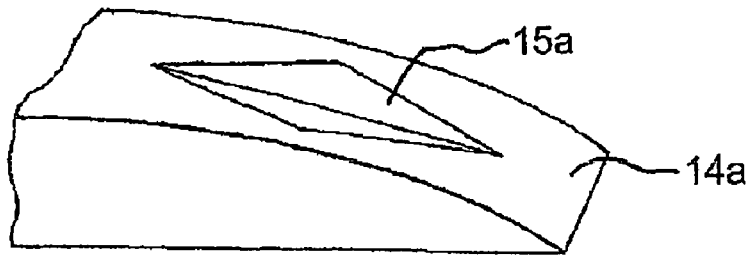
FIGS. 8 to 18 illustrate various alternative blade configurations as may be used with a centraliser of the present invention.
Figure 9:
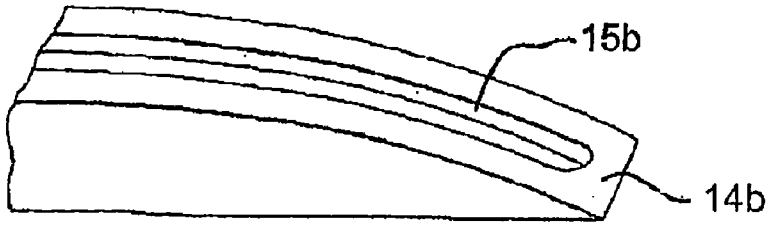
Figure 10:
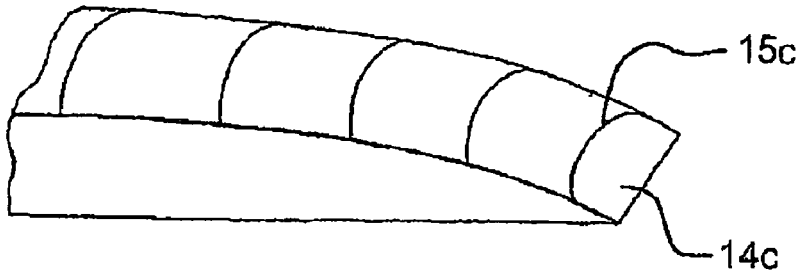
Figure 11:
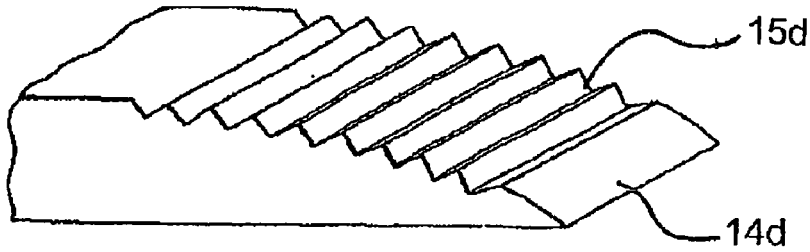
Figure 12:
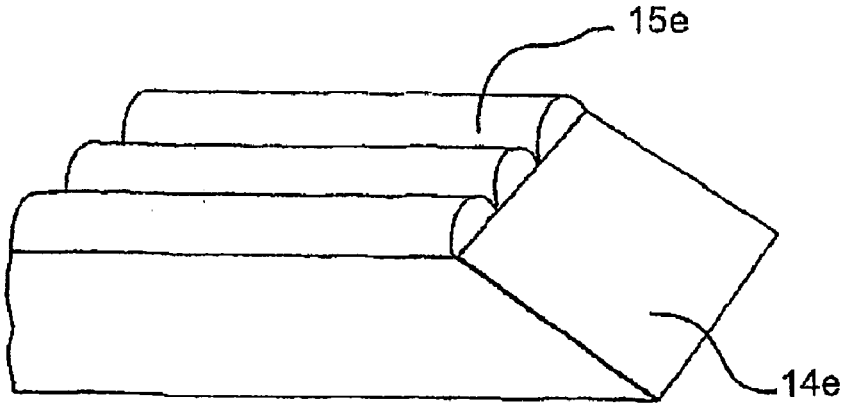
Figure 13:
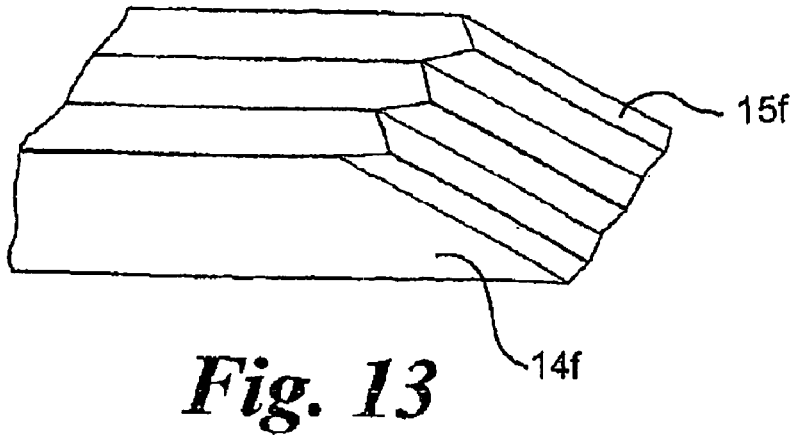
Figure 14:
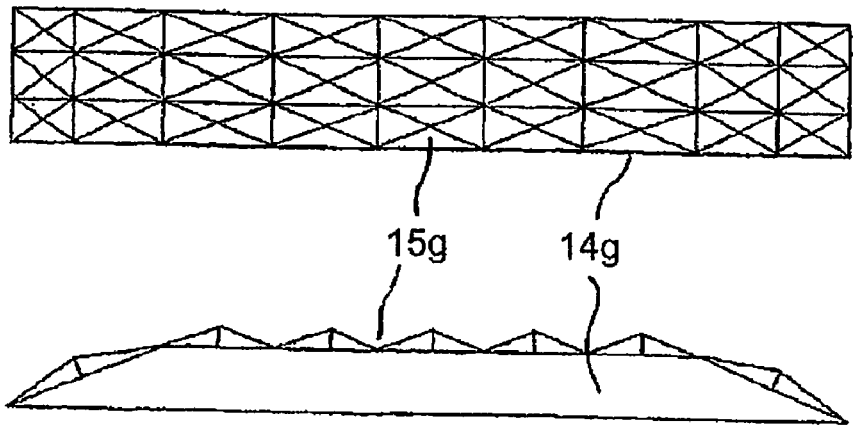
Figure 15:
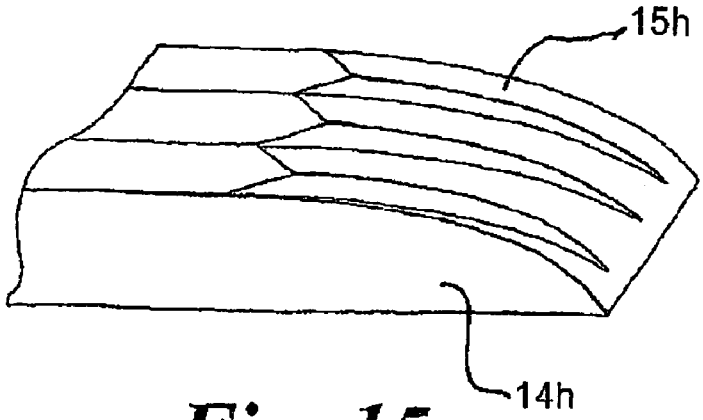

A similar arrangement may be provided with stop collars as may be used with centralisers of certain embodiments of the invention, to permit or restrict rotation as desired. Such a stop collar 74 is illustrated in FIG. 7. The collar 74 has an internal recess 76 in which a snap-ring is mounted, while a number of Allen screws 78 are mounted in thickened portions 80 of the collar 74, in communication with the recess 76.

FIGS. 8 to 18 illustrate various different blade configurations which may be provided on the centraliser of embodiments of the present invention. Each blade arrangement has effects on the flow of fluids over the centraliser and the cutting ability of the blades. For example, certain of the blades, for example, those illustrated in FIG. 8 by numeral 14*a* and FIG. 9 by 14*b*, have recessed channels 15*a*, 15*b*, respectively, running along the long axis of the blade. These channels allow cuttings and fluid to flow past the blade even while the blade is cutting, so improving the blade's ability to clean out a bore. Differently shaped features to perform such functions are shown at 15*c* in blade 14*c* in FIG. 10, at 15*d* on blade 14*d* in FIG. 11, at 15*e* on blade 14*e* in FIG. 12, and at 15*f* on blade 14*f* in FIG. 13. Still other, differently shaped features to perform such functions are shown at 15*g* on blade 14*g* in FIG. 14 and at 15*h* on blade 14*h* in FIG. 15.

Figure 16:
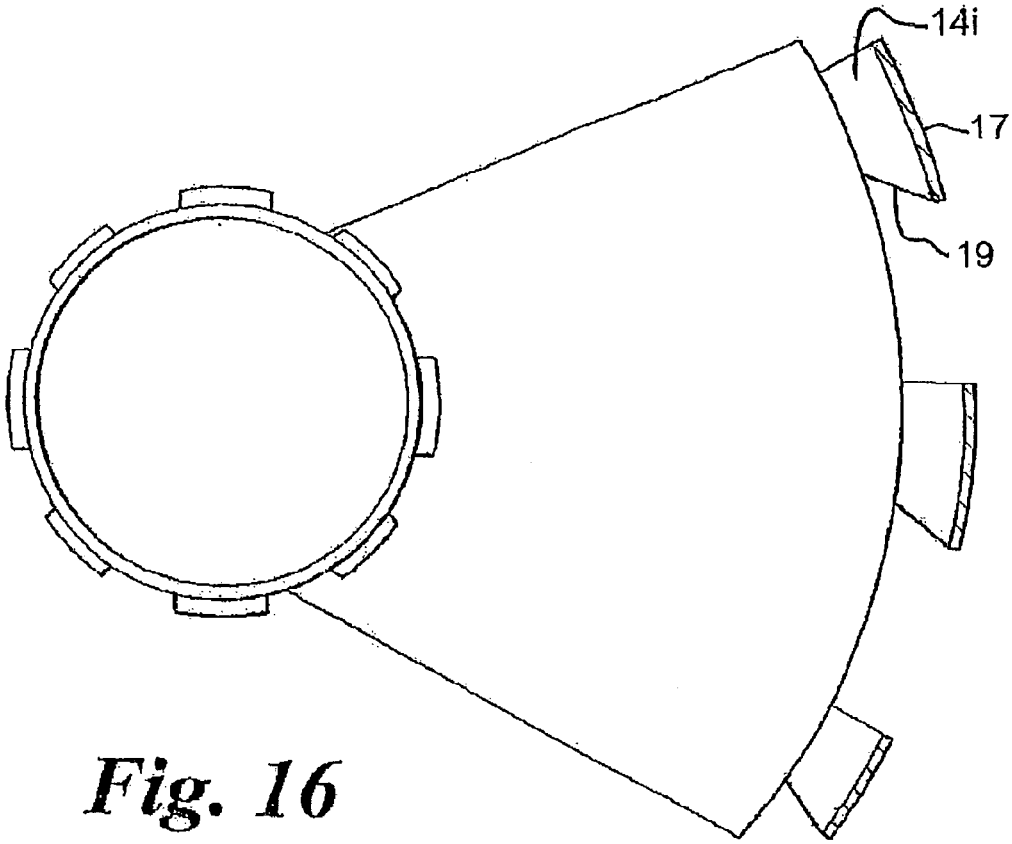
Figure 17:
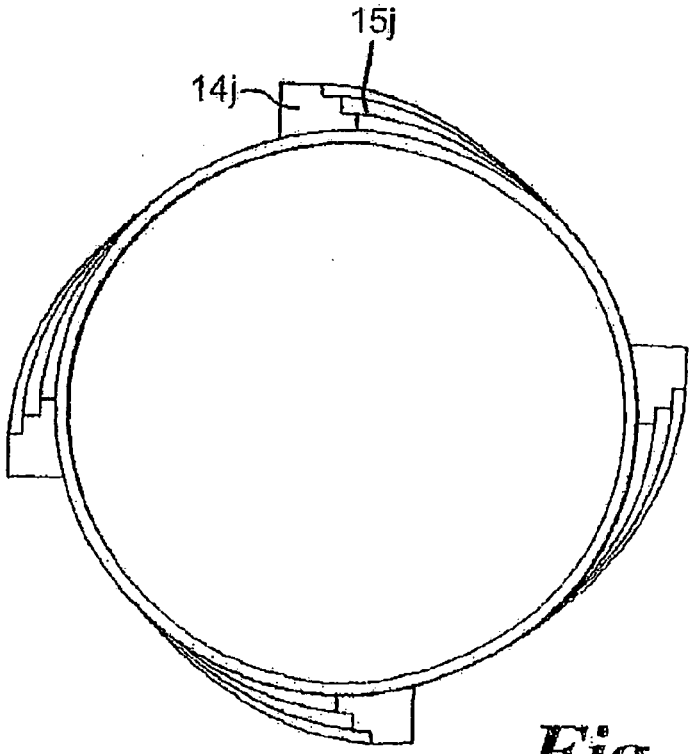

The blades 15*j* shown in FIG. 16 have an outer surface coating of hard facing, and are formed with an angled leading edge 14*j*, so that the hard facing overhangs the base of the blade.

Figure 18:
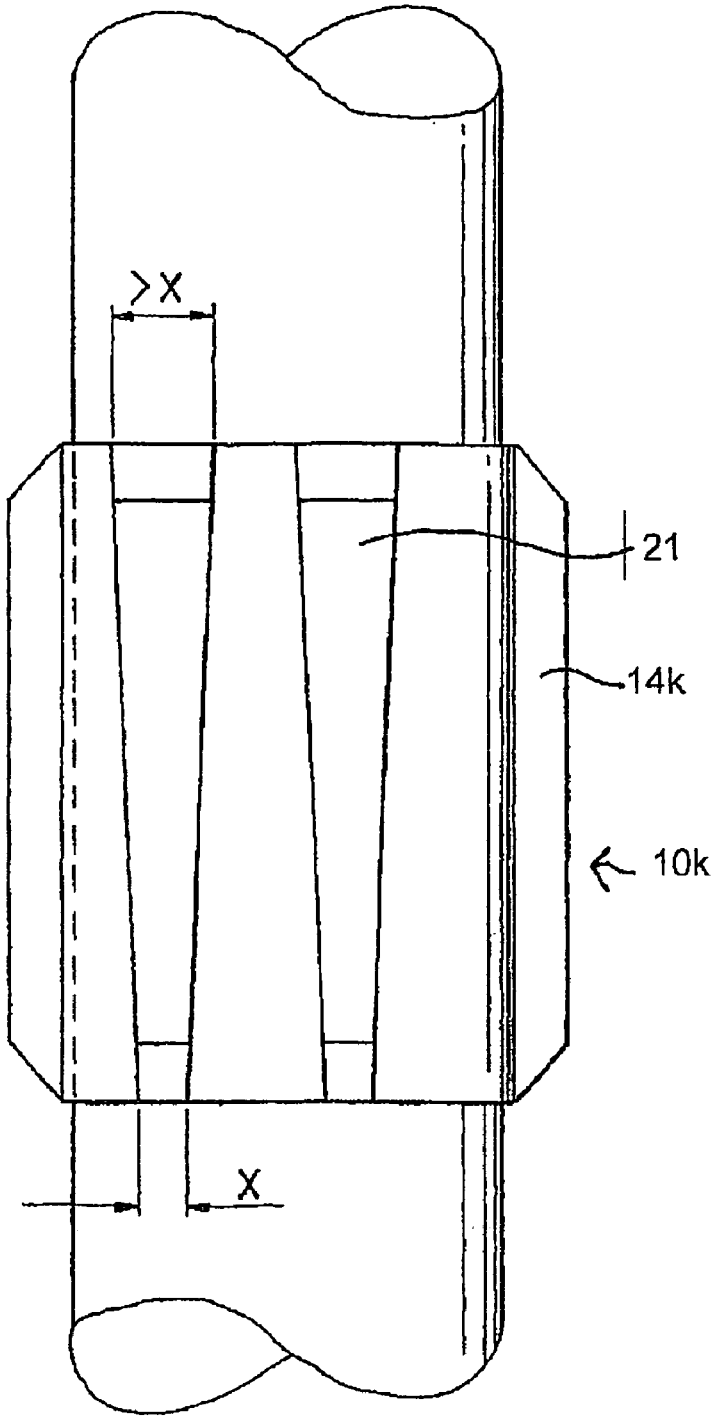

The arrangement of the blades 14*k* shown in FIG. 18 provides a venturi-like flow across the centraliser 10*k*; that is, the formation of a constriction in the closed channel/flute 21 carrying the fluid increases the velocity and kinetic energy of the fluid at the point of constriction, to promote turbulent fluid flow and to maximise jetting effects in connection with mixing of the swept cutting bed particulate within the well bore fluids. Such a blade arrangement may be used with any of the other centralisers described herein.

Figure 19:
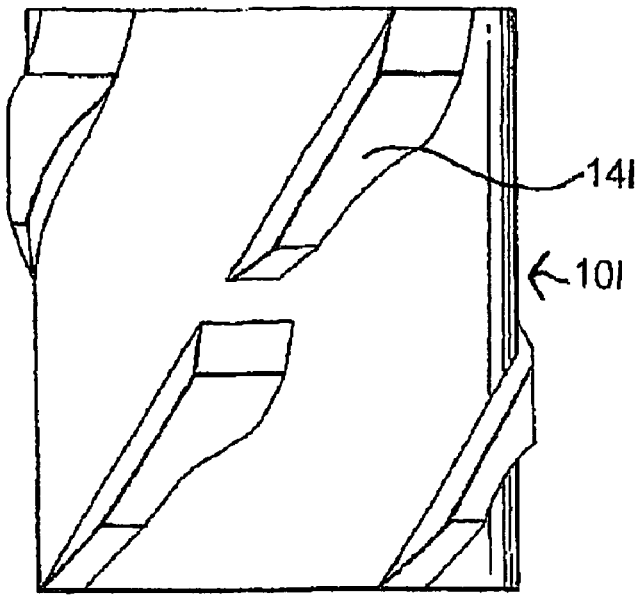
FIGS. 19 to 21 illustrate further embodiments of a centraliser in accordance with the present invention, arranged to provide a turbulent fluid flow in the bore and to provide rotation of the centraliser.

FIG. 19 shows a centraliser according to the present invention with a blade configuration selected to provide a turbulent fluid flow over the centraliser and to cause rotational force to be exerted on the centraliser. It can be seen from the Figure that the two-part helical blades 14*l* of the centraliser 10*l* are rectilinear on one side face thereof while the opposite side face curves outwards, and is generally rounded. Other configurations may be straight-edged, provided the blades generally form a fluid constriction with the circumferentially adjacent blade. This provides a channel between the blades which narrows, broadens, then narrows, as fluid passes upwards and over the centraliser. The variation in channel size results in a change in fluid flow direction, speed and pressure as fluid flows upward between the blades. Once the fluid passes beyond the end of each blade part, the fluid speed drops, leading to turbulent fluid flow. The change in fluid flow causes the fluid to exert a generally lateral force on the centraliser, so leading to rotation of the centraliser in the absence of any countervailing force. This rotation causes any drill cuttings and the like lying in the bore to be agitated and entrained in the fluid flow over the centraliser. Similarly, the turbulence of the flow over the centraliser assists in carrying and entraining particulates and the like along with the fluid, so preventing build up of these particulates on the centraliser or in the bore. This results in a cleaner bore and centraliser than with conventional centraliser arrangements.

Figure 20:
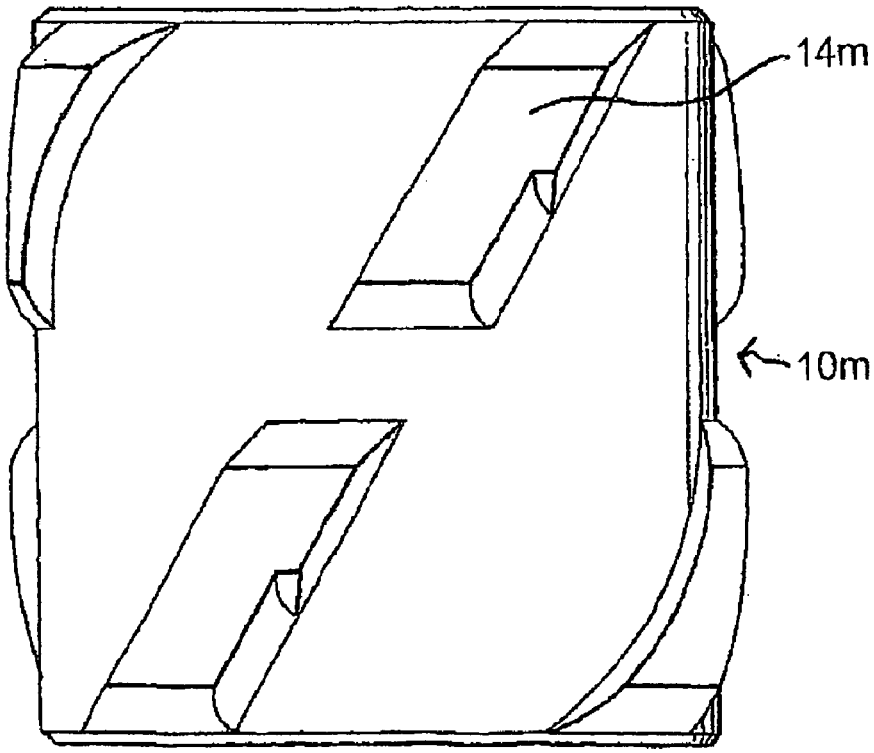
Figure 21:
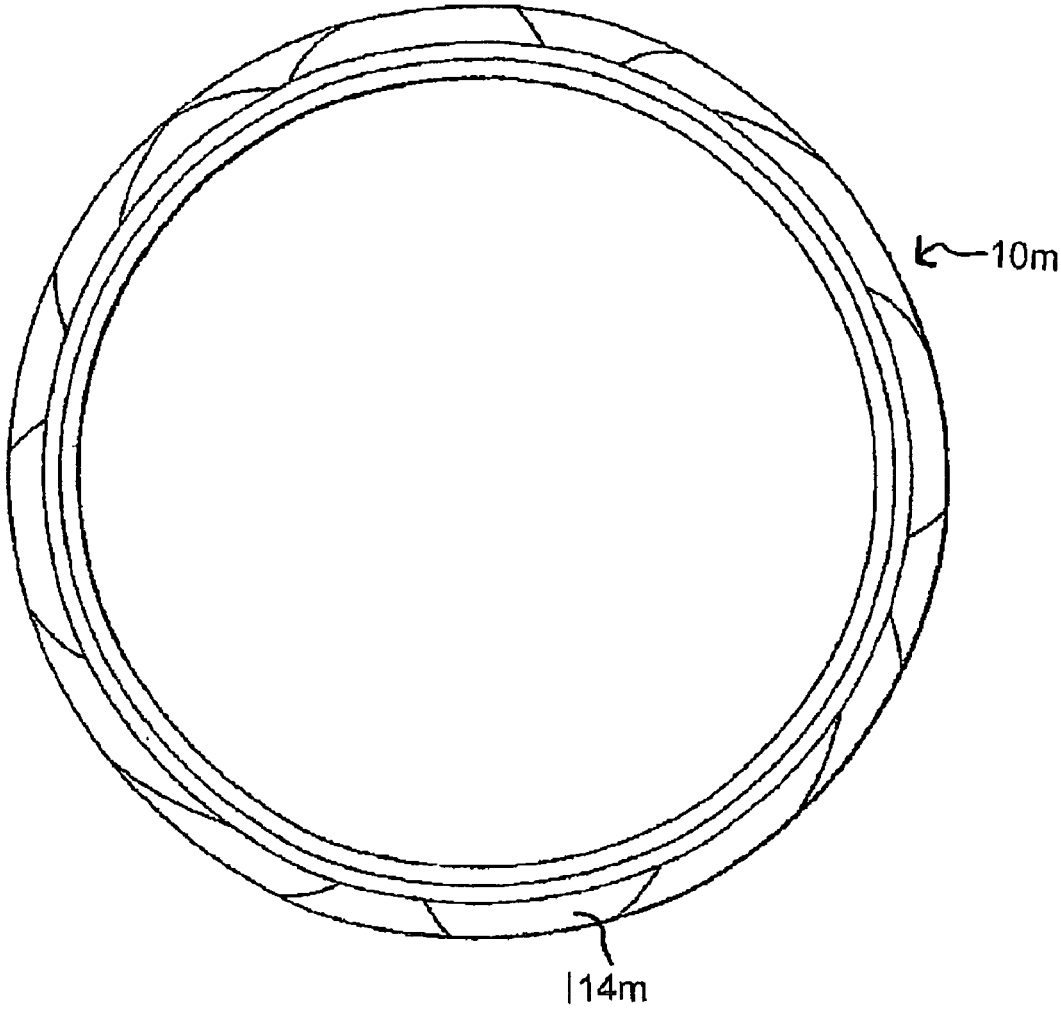

FIGS. 20 and 21 show an alternative centraliser arrangement to that shown in FIG. 19, but which also provides for a turbulent fluid flow and rotation of the centraliser. The centraliser 101 of FIG. 19 is made substantially from Austempered Ductile Iron, while that of FIGS. 20 and 21 is made from plastics material. FIG. 21 shows a view of the centraliser 10*m* of FIG. 20 from above; it will be seen that the blades 14*m* of the centraliser 10*m* are wrapped around the centraliser body, and that complete coverage of the circumference of the body is obtained. The centraliser 10*m* functions in much the same manner as the centraliser 101 of FIG. 19, to provide a turbulent fluid flow, alternate blade parts each having a rectilinear side face and a curved side face, and a rectilinear side face and a side face featuring a concave cut-out, which provides a "scooping" action if the centraliser is rotating. Alternatively, the blades may have straight side faces, provided there is a change in blade width.

Figure 22:
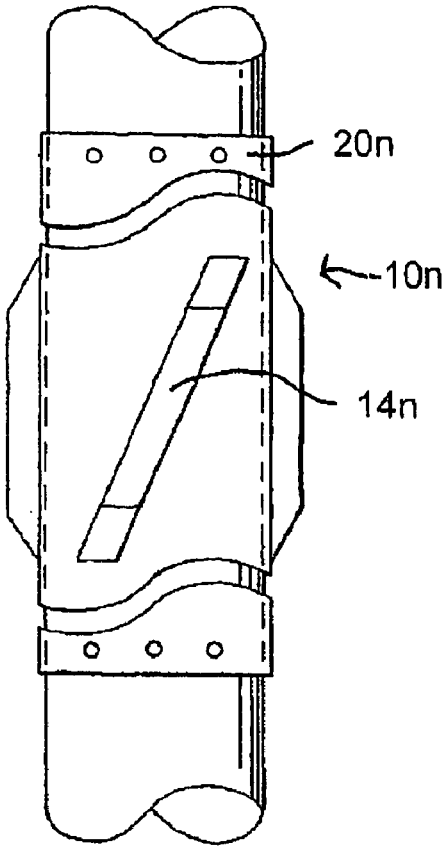
FIG. 22 shows a further alternative centraliser and stop collar combination in accordance with an embodiment of the present invention.

FIG. 22 shows a further alternative centraliser and stop collar arrangement, in which both collars 20*n* and the centraliser 10*n* are provided with mateable profiles in the form of co-operating wave formation surfaces. Various other mateable profile configurations may be used. The centraliser will normally rest at the centre of its range of axial movement, out of contact with either of the collars, and rotatable relative to the casing. However, if the centraliser encounters an obstruction in the bore the centraliser will be urged against one of the collars, depending on the direction of axial movement of the casing, thus causing the centraliser 10*n* to rotate with the casing and causing the blades 14*n* to ream the bore wall.

Figure 23:
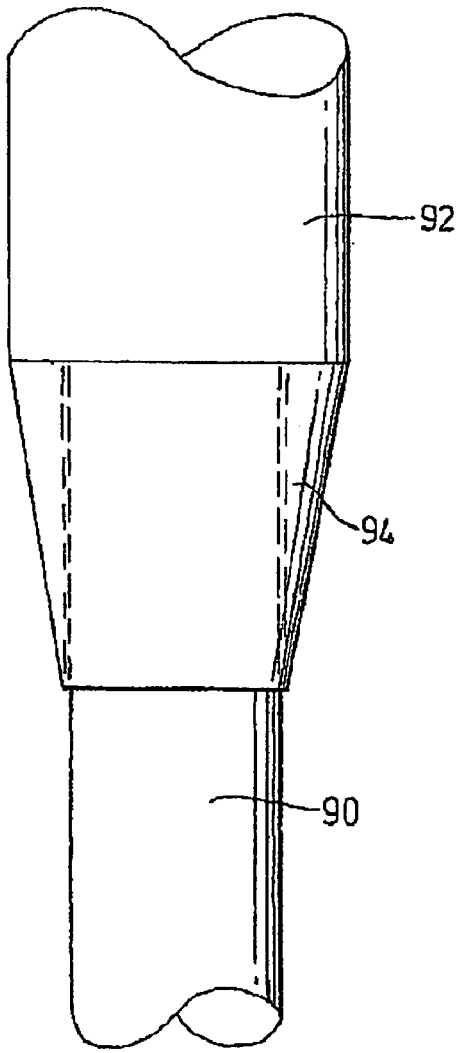
FIG. 23 shows a body for mounting on a casing string in accordance with a further embodiment of the invention.

FIG. 23 shows a body for mounting on a casing string in accordance with a further embodiment of the invention. Casing sections 90 are joined together by tubular connectors 92 of larger bore than the casing 90. The body 94 of the invention has a tapering profile, and is mounted adjacent the connector 92 such that the taper leads away from the connector 92. This assists in the flow of cuttings and other debris past the connector 92. This aspect of the invention may, if desired, be combined with features of the other embodiments described herein.

Figure 24:
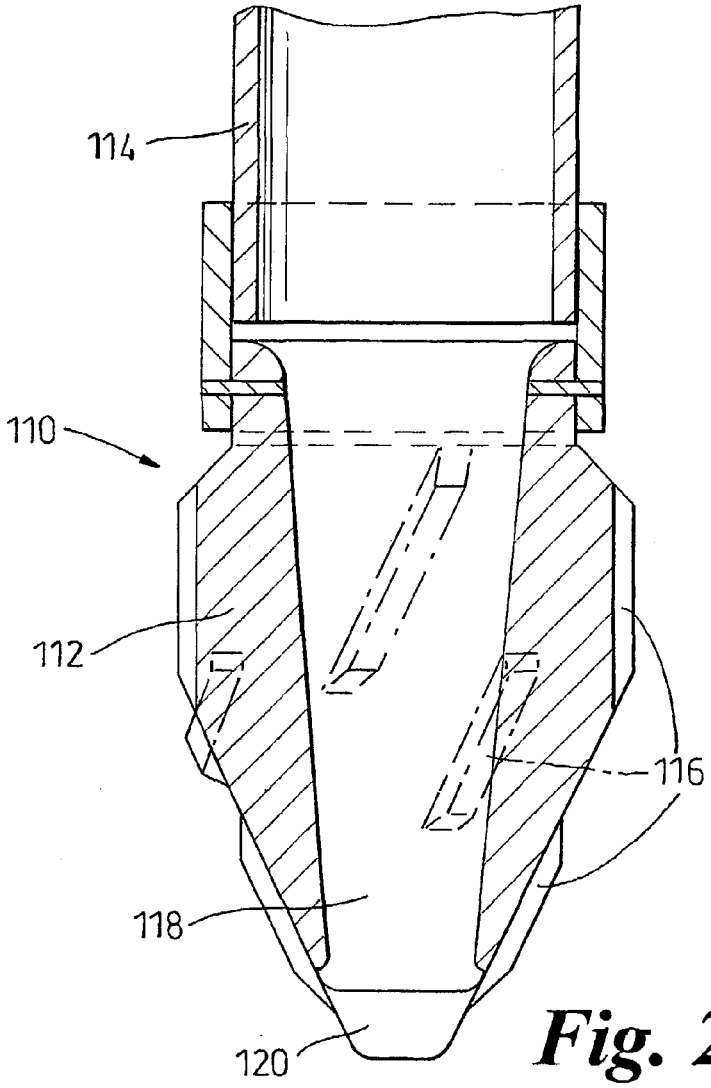
FIGS. 24 and 25 show sectional and end views of a casing shoe in accordance with an embodiment of the present invention.
Figure 25:
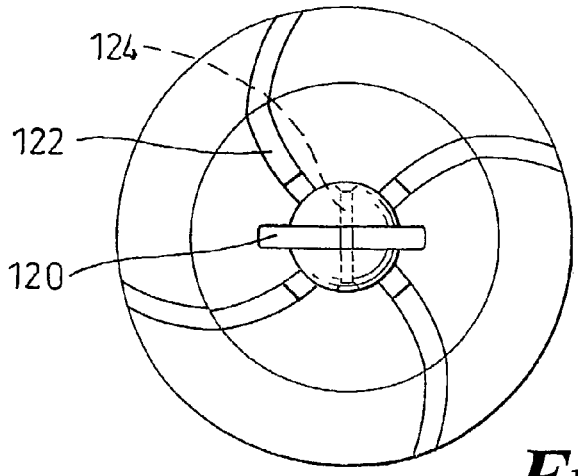

FIGS. 24 and 25 show side and end sectional views of a casing shoe in accordance with an embodiment of the invention. The shoe 110 comprises a body 112 mounted on the end of a tubular section 114. The body 112 carries a number of blades 116, each of which carries a coating of hard facing material. A bore 118 extends through the body 112, leading to a slot-like opening 120 at the tip of the body 112. The opening 120 is also surrounded by portions of hard facing material 122, and carries a pin 124 mounted across the opening 120 perpendicular to the slot. In use, as the shoe 110 is advanced and rotated into a bore, the blades 116 and sections of hard facing material 122 around the opening 120 ream or cut any obstructions and debris within the bore. Fluid may be pumped along the bore 118 within the shoe 110, which fluid leaves the opening 120 and entrains cuttings and the like in its flow. This serves to carry cuttings and waste away from the end of the string, so preventing deposition and accumulation of waste. The slot-like form of the opening 120 means that should a particle of waste block a section of the opening 120, fluid is still able to be pumped out from the opening 120 around the obstruction. The bolt 124 across the opening 120 serves to hold the edges of the opening 120 together against any forces tending to splay the opening 120 (for example, if the opening 120 does become obstructed), so reducing the likelihood of failure of the shoe 110.

It will be apparent to the skilled person that the foregoing is for illustrative purposes only, and that various modifications and variations may be made to the apparatus described herein without departing from the scope of the invention. It is further envisaged that any number of the above features may be combined and adapted for use with a spring bow centraliser (that is, a centraliser which incorporates sprung blades). Although described herein primarily with reference to casing sections, it will be apparent to the skilled person that the invention may be used with other tubulars, such as drill pipe sections, or may be mounted on a mandrel for insertion into a drill string.

The invention claimed is:

1. A centraliser used to facilitate the running in and cementing of casing, said centraliser comprising:

a body adapted for mounting on a casing, said body defining a plurality of substantially rigid blades; and at least one stop for mounting on the casing, said at least one stop having a first end carrying a means for selectively engaging, an end of the body to selectively restrict relative rotation between the body and the casing, the at least one stop being mountable in a first orientation relative to the body such that in the first orientation the first end of the stop is adapted to engage and rotate the body and is opposable to the end of the body, and in a second orientation the first end of the stop does not engage with the body and is unopposable to the end of the body.

2. The centraliser of claim 1 wherein said at least one stop further comprises a second end located away from the body relative to the first end which does not engage with the body to restrict relative rotation between the body and the casing when the second end of the stop is contact with the body.

3. The centraliser of claim 1 wherein the at least one stop is adapted to be fixed relative to the casing and the body is adapted to be normally rotatable relative to the casing.

4. The centraliser of claim 1 wherein the at least one stop is fixed to the casing by set screws.

5. The centraliser of claim 1 wherein the first end of the stop and the end of the body define respective cooperating formations which are adapted to selectively engage to restrict rotation therebetween.

6. The centraliser of claim 5 wherein the body is adapted to be axially moveable relative to the casing such that the end of the body is axially moveable into and out of engagement with the stop.

7. The centraliser of claim 6 wherein the stop and body are adapted and located such that axial movement of the casing through a bore in one direction will tend to separate the stop and body, permitting rotation of the body relative to the casing, while movement of the casing in the opposite direction will tend to bring the stop and body together, such that the body is rotatable with the casing when the stop presents the first end to the end of the body.

8. The centraliser of claim 1 wherein the body further includes two stops, and the body is adapted for mounting on the casing between the stops and configured such that the body is selectively rotatable with the casing while the casing is being run into a bore and also while being retrieved from the bore.

9. The centraliser of claim 1, wherein the body is nonrotatable relative to the casing on experiencing an axial force in excess of a predetermined level.

10. The centraliser of claim 1, wherein the body is rotatable relative to the casing on experiencing a torque above a predetermined level.

11. The centraliser of claim 1, wherein the blades are configured to provide a stand-off between the casing and the bore wall and permit fluid circulation past the centraliser.

12. The centraliser of claim 1 wherein each adjoining pair of the plurality of blades is separated by at least one flute.

13. The centraliser of claim 12 wherein at least one of the blades and the respective flute are configured to induce a rotational torque on the centraliser as fluid passes between the blades.

14. The centraliser of claim 1 wherein the blades are configured to provide a nozzle effect on fluid flowing between the blades.

15. The centraliser of claim 14 wherein at least a portion of one of the plurality of blades is configured to taper along at least one part of a length of the centraliser.

16. The centraliser of claim 1 wherein the blades are configured to provide for turbulent fluid flow between blades.

17. The centraliser of claim 1 wherein the blades are configured to taper along at least part of a length of the centraliser to provide a change in the velocity and kinetic energy of fluid flowing along the centraliser.

18. The centraliser of claim 1, further comprising a bearing for engaging the casing.

19. The centraliser of claim 18, wherein the bearing is configured so as to encourage thin film lubrication between the centraliser and the casing.

20. The centraliser of claim 19 wherein the bearing is configured so as to provide sacrificial self-lubrication in the event that thin film lubrication should break down.

21. The centraliser of claim 1 wherein the blades are formed of a sacrificial self-lubricating material to minimize friction between the centraliser and a bore wall.

22. The centraliser of claim 1 wherein the body is formed of polymeric material.

23. The centraliser of claim 1 wherein the body is formed of metal.

24. The centraliser of claim 1 wherein the body comprises a frame of relatively hard material which is disposed on a portion of soft material.

25. The centraliser of claim 1 wherein the body is formed of at least two parts configured so as to allow the body to be fitted around a casing.

26. The centraliser of claim 1, wherein the at least one stop comprises at least two parts, such that when the parts are coupled together, a portion of at least one of the parts is urged into engagement with the casing.

27. The centraliser of claim 1, wherein the at least one stop comprises at least two parts arranged to separate when subjected to a torque above a predetermined level.

28. The centraliser of claim 1, wherein the at least one stop comprises a body portion and a radially moveable gripping part for selectively engaging the casing, and means for urging the gripping part into engagement with the casing.

29. The centraliser of claim 1 wherein the at least one stop has a tapering leading face, to facilitate movement over ledges and to prevent the build up of debris in front of the stop.

30. The centraliser of claim 1 wherein the at least one stop is formed of a softer material than the body.

31. The centraliser of claim 1 wherein a wall thickness of the centraliser varies along a length of the centraliser to provide a change in the velocity and kinetic energy of fluid flowing along the centraliser.

32. The centraliser of claim 1, wherein at least one blade comprises at least two axially spaced blade portions.

33. The centraliser of claim 1, wherein at least one blade comprises at least two axially spaced blade portions, the blade portions being axially offset from one another.

34. The centraliser of claim 1, wherein the blades have cutting edges.

35. The centraliser of claim 1, wherein the body is substantially solid and the blades are formed integrally of the body, and the blades define a fixed diameter selected to be smaller than a bore into which the casing is run and cemented.

36. A method of reaming a bore, comprising running a casing having a bladed centraliser body and a stop disposed on the casing, the stop having a first end carrying a means for selectively rotationally engaging the body into a previously drilled bore, and selectively rotationally coupling the body to the casing and rotating the body with the casing. thereby causing the body to ream the bore.

37. A method for running a casing, comprising:

affixing selectively rotatably engageable centralizers to the exterior of the casing;

inserting the casing into a wellbore;

selectively engaging the centralizers;

rotating the casing with the engaged centralizers to ream the wellbore; and continuing to insert the casing into the wellbore after an obstruction is removed by the reaming.

* * * * *